US006445120B1

(12) United States Patent
Kim et al.

(10) Patent No.: US 6,445,120 B1
(45) Date of Patent: Sep. 3, 2002

(54) PLASMA DISPLAY PANEL WITH IMPROVED STRUCTURE OF DISCHARGE ELECTRODE AND DIELECTRIC LAYER

(75) Inventors: Jae Sung Kim; Masahiko Tamura, both of Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/427,751

(22) Filed: Oct. 27, 1999

(30) Foreign Application Priority Data

Oct. 28, 1998 (KR) ..... 98-45525
Oct. 28, 1998 (KR) ..... 98-45526

(51) Int. Cl.[7] ..... H01J 17/04; H01J 63/02; H01J 17/48; H01J 17/49

(52) U.S. Cl. ..... 313/491; 313/581; 313/582; 313/584; 313/586

(58) Field of Search ..... 313/491, 584, 313/585, 586, 582, 587, 581, 583

(56) References Cited

U.S. PATENT DOCUMENTS 5,587,624 A * 12/1996 Komaki ..... 313/584
5,640,068 A * 6/1997 Amemiya ..... 313/582
5,742,122 A * 4/1998 Amemiya et al. ..... 313/582
6,157,128 A * 12/2000 Namiki et al. ..... 313/581
6,255,779 B1 * 7/2001 Ha et al. ..... 313/582

FOREIGN PATENT DOCUMENTS

JP 53-59367 5/1978 ..... H01J/17/04
JP 10-321142 12/1998 ..... H01J/11/02
JP 11067099 * 3/1999 ..... H01J/11/02

* cited by examiner

*Primary Examiner*—Nimeshkumar D. Patel
*Assistant Examiner*—Sikha Roy
(74) *Attorney, Agent, or Firm*—Fleshner & Kim, LLP

(57) ABSTRACT

A plasma display panel in which a structure of a discharge electrode and dielectric layer is provided to generate ultraviolet rays in a positive column area includes: a plurality of first and second bus electrodes successively formed on a substrate at a predetermined interval; a plurality of first discharge electrodes formed with a plurality of first branches branched at a first width for each first bus electrode, a plurality of first centers extended from the first branches to a second width greater than the first width, and a plurality of first ends extended from the first centers to a third width smaller than the second width; a plurality of second discharge electrodes successively branched at a predetermined interval for each second bus electrode and spaced apart from the first ends; and a dielectric layer deposited on areas between the first and second discharge electrodes at a first thickness and on some areas on the first and second discharge electrodes at a second thickness.

16 Claims, 11 Drawing Sheets

PLASMA DISPLAY PANEL WITH IMPROVED STRUCTURE OF DISCHARGE ELECTRODE AND DIELECTRIC LAYER

BACKGROUND OF THE INVENTION

1. Field of the Invention

The present invention relates to a plasma display panel, and more particularly, to a structure of a discharge electrode and dielectric layer for a plasma display panel, which reduces discharge current.

2. Background of the Related Art

Generally, a plasma display panel and a liquid crystal display (LCD) have lately attracted considerable attention as the most practical next display of panel displays. In particular, the plasma display panel has higher luminance and wider visible angle than the LCD. For this reason, the plasma display panel is widely used as a thin type large display such as an outdoor advertising tower, a wall TV, and a theater display.

FIG. 1*a* shows a structure of a related art plasma display panel of three-electrode area discharge type. As shown in FIG. 1*a,* the plasma display panel of three-electrode area discharge type includes an upper substrate 10 and a lower substrate 20 which are bonded opposite to each other. FIG. 1*b* shows a sectional structure of the plasma display panel of FIG. 1*a,* in which the lower substrate 20 is rotated by 90°.

The upper substrate 10 includes scan electrodes 16 and 16', sustain electrodes 17 and 17', a dielectric layer 11, and a passivation film 12. The scan electrodes 16 and 16' are formed in parallel to the sustain electrodes 17 and 17'. The dielectric layer 11 is deposited on the scan electrodes 16 and 16' and the sustain electrodes 17 and 17'.

The lower substrate 20 includes an address electrode 22, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and the dielectric film 21. Inert gases such as He and Xe are mixed in a space between the upper substrate 10 and the lower substrate 20 at a pressure of 400 to 500 Torr. The space is used as a discharge area.

In general, a mixing gas of He—Xe is used as the inert gas filled in a discharge area of a DC plasma display panel while a mixing gas of Ne—Xe is used as the inert gas filled in a discharge area of an AC plasma display panel.

The scan electrodes 16 and 16' and the sustain electrodes 17 and 17' include discharge electrodes 16 and 17 and bus electrodes 16' and 17' of metal so as to increase optical transmitivity of each discharge cell, as shown in FIGS. 2*a* and 2*b*. FIG. 2*a* is a plane view of the sustain electrodes 17 and 17' and the scan electrodes 16 and 16' and FIG. 2*b* is a sectional view thereof.

A discharge voltage is applied to the bus electrodes 16' and 171 from an externally provided driving integrated circuit(IC). The discharge voltage is applied to the discharge electrodes 16 and 17 to generate discharge between the adjacent discharge electrodes 16 and 17. The discharge electrodes 16 and 17 have an overall width of about 300 $\mu$m and are made of indium oxide or tin oxide. The bus electrodes 16' and 17' are formed of three-layered thin film of Cr—Cu—Cr. At this time, the bus electrodes 161 and 171 have a line width of ⅓ of a line width of the discharge electrodes 16 and 17.

FIG. 3 is a wiring diagram of scan electrodes ($S_{m-1}$, $S_m$, $S_{m+1}$, . . . , $S_{n-1}$, $S_n$, $Sn_{n+1}$) and sustain electrodes ($C_{m-1}$, $C_m$, $C_{m+1}$, . . . , $C_{n-1}$, $C_n$, $C_{+1}$) arranged on the upper substrate. In FIG. 3, the scan electrodes are insulated from one another while the sustain electrodes are connected in parallel. Particularly, a block indicated by a dotted line in FIG. 3 shows an active area where an image is displayed and the other blocks show inactive areas where an image is not displayed. The scan electrodes arranged in the inactive areas are generally called dummy electrodes 26. The number of the dummy electrodes 26 are not specially limited.

The operation of the aforementioned AC plasma display panel of three-electrode area discharge type will be described with reference to FIGS. 4*a* to 4*d*.

If a driving voltage is applied between the address electrodes and the scan electrodes, opposite discharge occurs between the address electrodes and the scan electrodes as shown in FIG. 4*a*. The inert gas implanted into the discharge cell is instantaneously excited by the opposite discharge. If the inert gas is again transited to the ground state, ions are generated. The generated ions or some electrons of quasi-excited state come into collision with a surface of the passivation film as shown in FIG. 4*b*. The collision of the electrons secondarily discharges electrons from the surface of the passivation film. The secondarily discharged electrons come into collision with a plasma gas to diffuse the discharge. If the opposite discharge between the address electrodes and the scan electrodes ends, wall charges having opposite polarities occur on the surface of the passivation film on the respective address electrodes and the scan electrodes.

If the discharge voltages having opposite polarities are continuously applied to the scan electrodes and the sustain electrodes and at the same time the driving voltage applied to the address electrodes is cut off, area discharge occurs in a discharge area on the surfaces of the dielectric layer and the passivation film due to potential difference between the scan electrodes and the sustain electrodes as shown in FIG. 4*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrodes and the isolation wall so that the phosphors are excited. The excited phosphors generate visible light rays, and the visible light rays display an image on a screen.

One pixel includes a discharge cell having a red phosphor, a discharge cell having a green phosphor, and a discharge cell having a blue phosphor. The plasma display panel displays contrast of an image by controlling the number of discharges in each discharge cell.

The related art plasma display panel has several problems.

Since the distance between the discharge areas is short as compared with a general discharge tube display, ultraviolet rays in a positive column area having good emitting efficiency are not generated. In other words, as shown in FIG. 9, since discharge current (2) generated in a discharge electrode spaced apart from a field convergence area is remarkably lower than discharge current (1) generated in a discharge electrode of the field convergence area, in the related art plasma display panel, discharge time is short. As a result, ultraviolet rays are generated in a negative glow area but are not generated in the positive column area. This reduces emitting efficiency and picture quality as compared with the general discharge tube.

SUMMARY OF THE INVENTION

Accordingly, the present invention is directed to a plasma display panel that substantially obviates one or more of the problems due to limitations and disadvantages of the related art.

An object of the present invention is to provide a plasma display panel in which a structure of a discharge electrode and dielectric layer is provided to generate ultraviolet rays in a positive column area.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a plasma display panel according to the present invention includes: a plurality of first and second bus electrodes successively formed on a substrate at a predetermined interval; a plurality of first discharge electrodes formed with a plurality of first branches branched at a first width for each first bus electrode, a plurality of first centers extended from the first branches to a second width greater than the first width, and a plurality of first ends extended from the first centers to a third width smaller than the second width; a plurality of second discharge electrodes successively branched at a predetermined interval for each second bus electrode and spaced apart from the first ends; and a dielectric layer deposited on areas between the first and second discharge electrodes at a first thickness and on some areas on the first and second discharge electrodes at a second thickness.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

First bus electrodes 1300 and second bus electrodes 1300' are successively formed on a substrate at a predetermined interval and are made of metal. The first bus electrodes 1300 and the second bus electrodes 1300' are formed of a three-layered thin film of Cr—Cu—Cr.

First discharge electrodes 1200 are successively formed for each first bus electrodes 1300 at a predetermined interval. Each of the first discharge electrodes 1200 includes a first branch 1210 branched by a first width for each first bus electrode, a first center 1220 extended from the first branch 1210 to a second width greater than the first width, and a first end 1230 extended from the first center 1220 to a third width smaller than the second width. At this time, the first end 1230 may have the same width as the first branch 1210, more preferably, a width wider than the first branch 1210.

Also, the second discharge electrodes 1200' are successively formed for each bus electrode 1300' at a predetermined interval. Each of the second discharge electrodes 1200' includes a second branch 1210' branched by a fourth width for each second bus electrode 1300', a second center 1220' extended from the second branch 1210' to a fifth width greater than the fourth width, and a second end 1230' extended from the second center 1220' to a sixth width smaller than the fifth width. At this time, the second end 1230' may have the same width as the second branch 1210', more preferably, a width wider than the second branch 1210'.

Figure 1A:
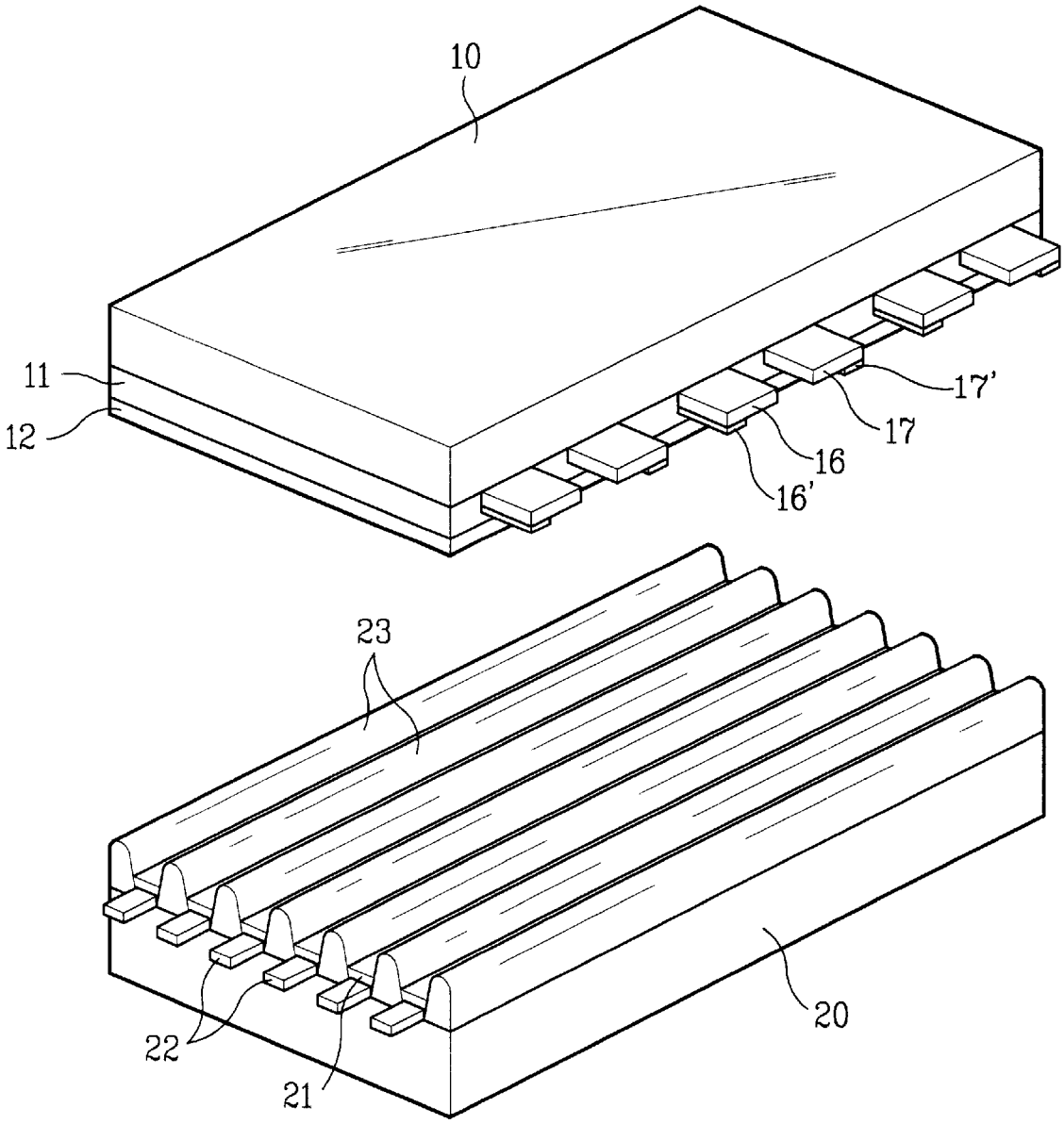
FIG.1A Background Art
FIGS. 1*a* and 1*b* show a structure of a related art plasma display panel.
Figure 1B:
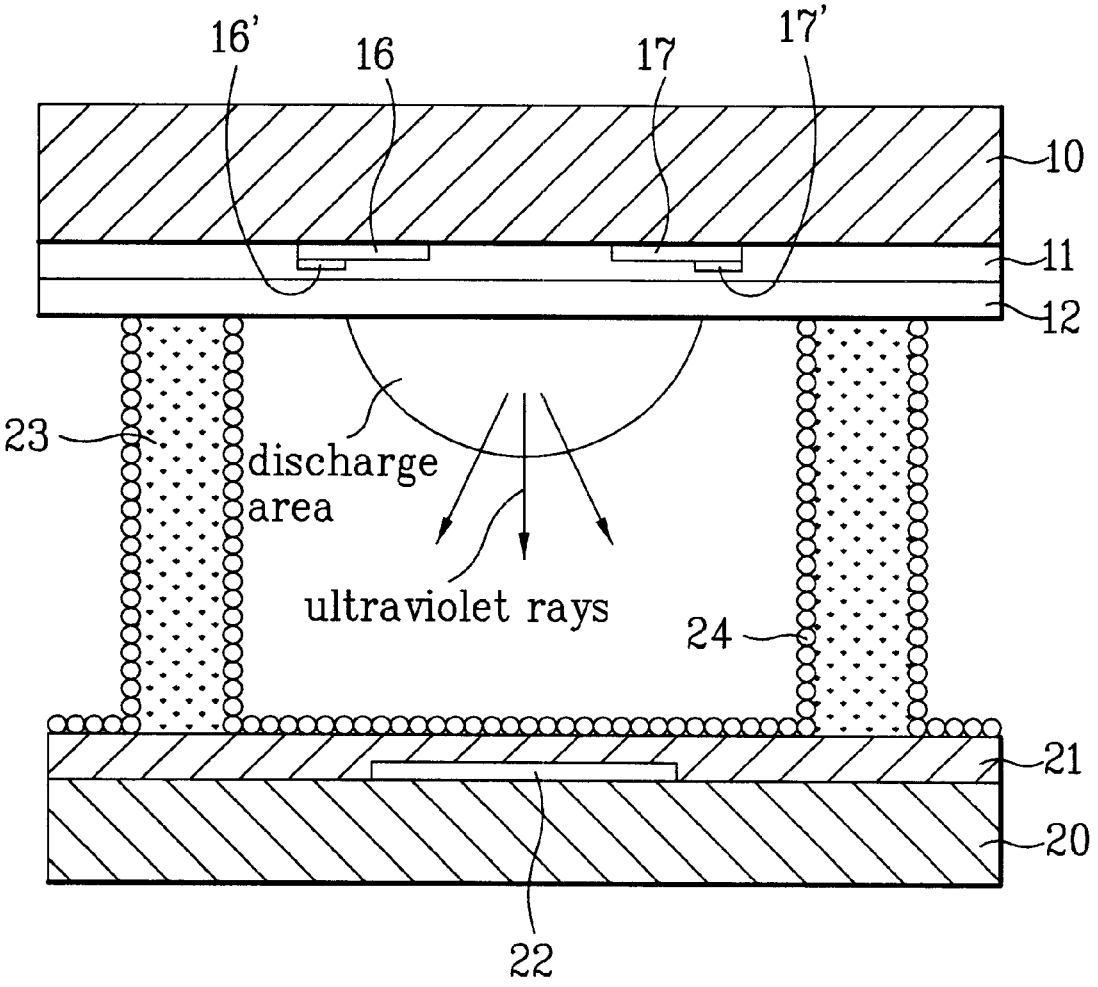
FIG.1B Background Art
Figure 2A:
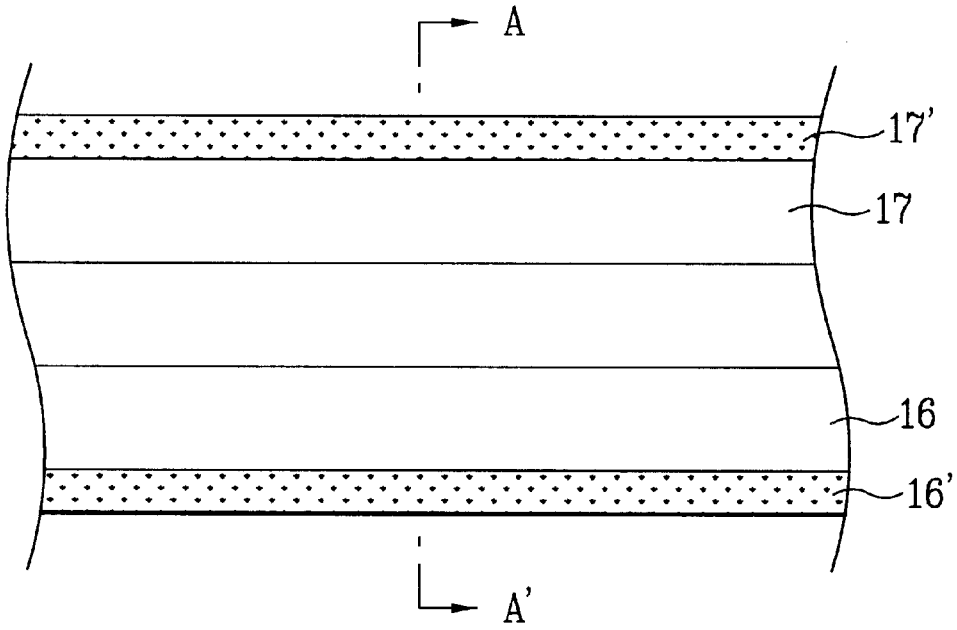
FIG.2A Background Art
FIGS. 2*a* and 2*b* show a structure of scan electrodes and sustain electrodes of a related art plasma display panel.
Figure 2B:
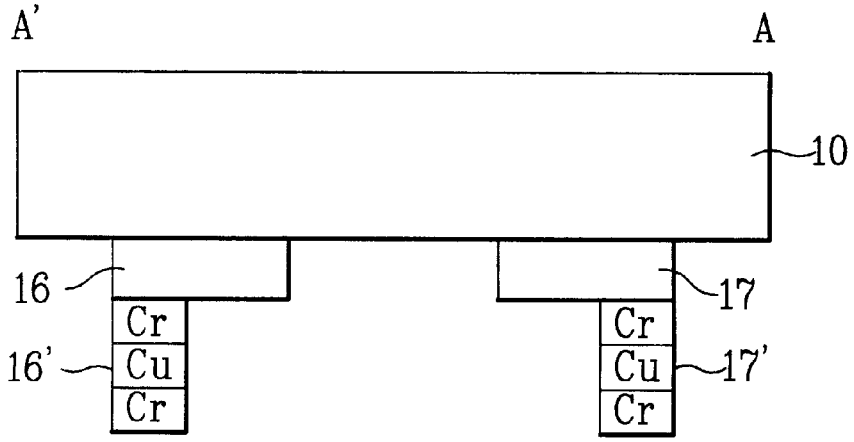
FIG.2B Background Art
Figure 3:
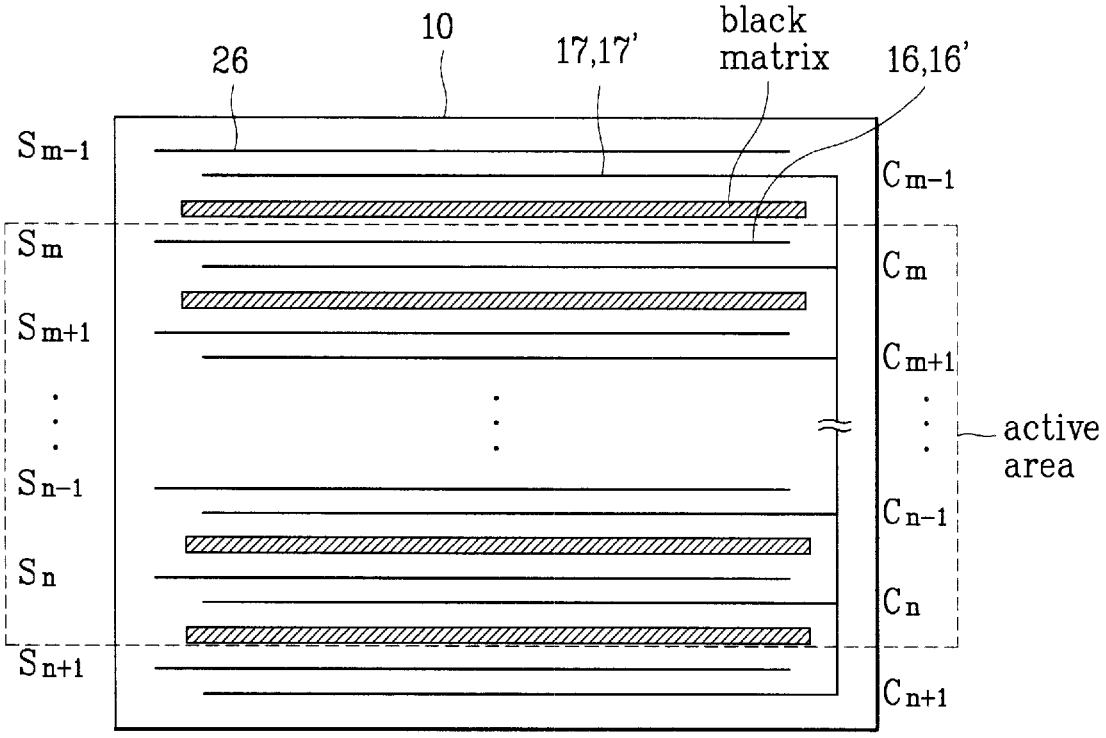
FIG.3 Background Art
FIG. 3 shows scan electrode lines and sustain electrode lines of a related art plasma display panel.
Figure 4A:
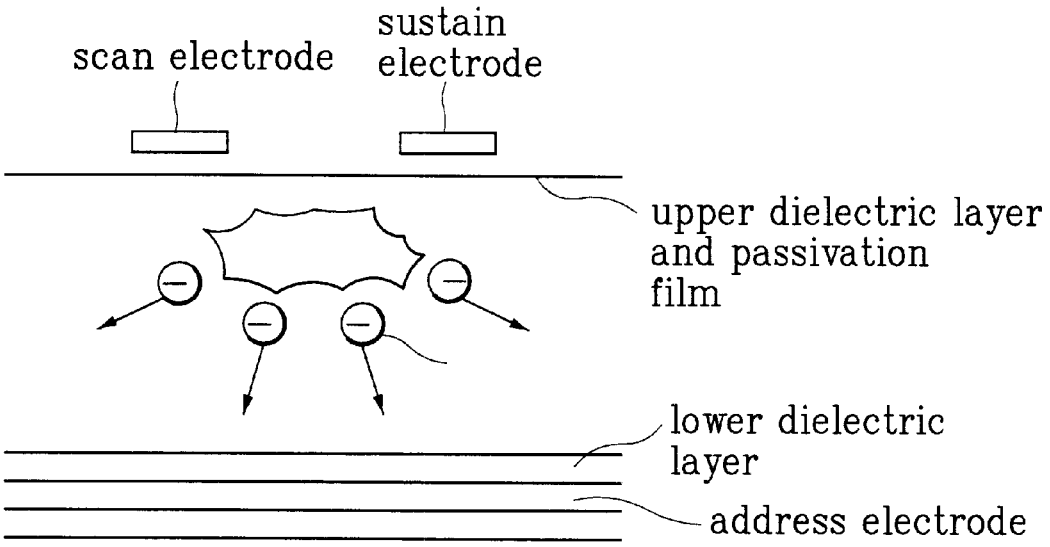
FIG. 4A Background Art
FIGS. 4*a* to 4*d* show discharge principle of a related art plasma display panel.
Figure 4B:
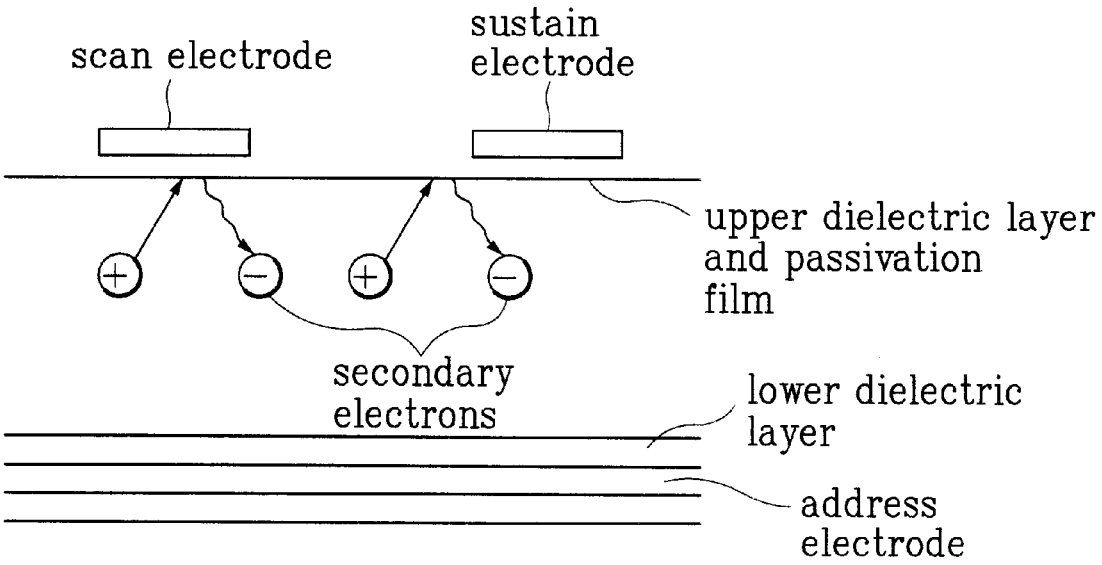
FIG. 4B Background Art
Figure 4C:
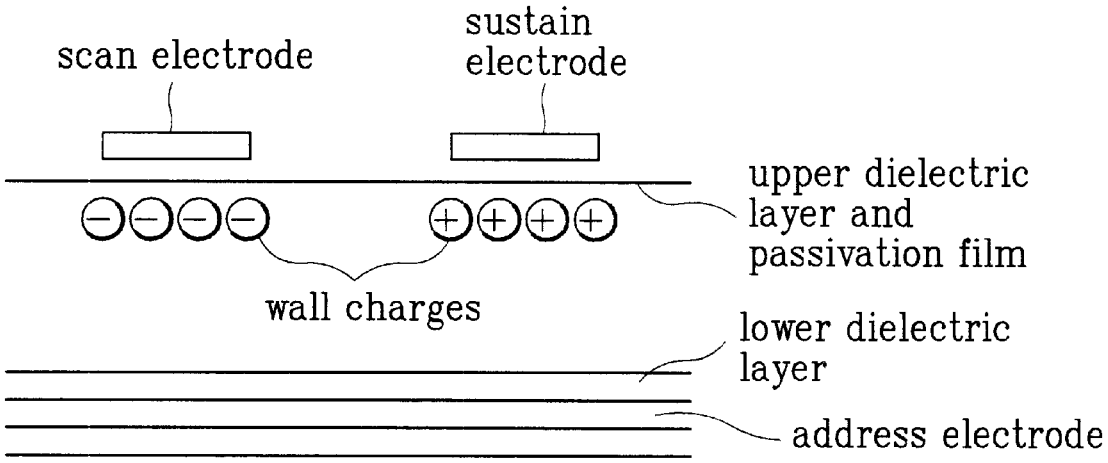
FIG. 4C Background Art
Figure 4D:
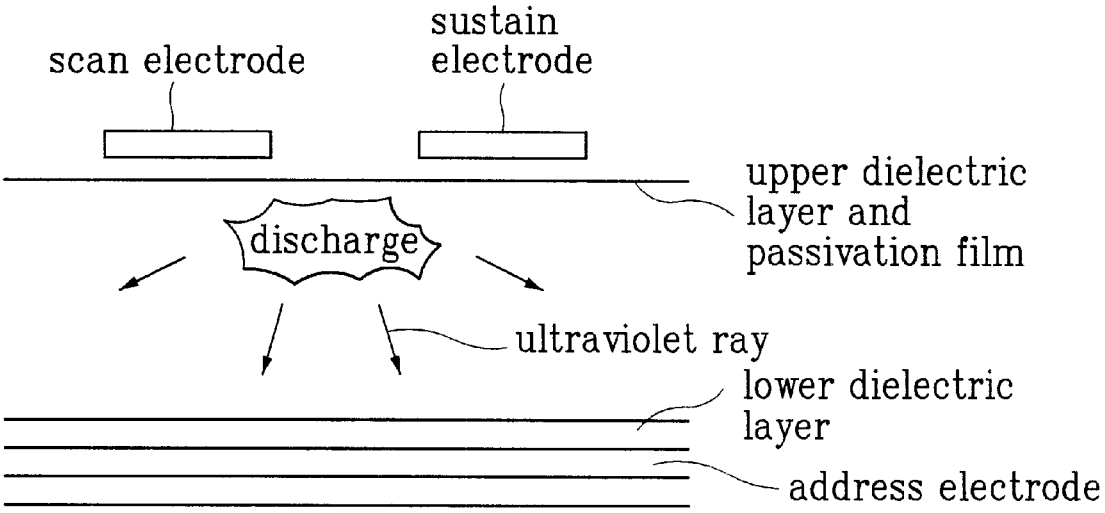
FIG. 4D Background Art
Figure 5:
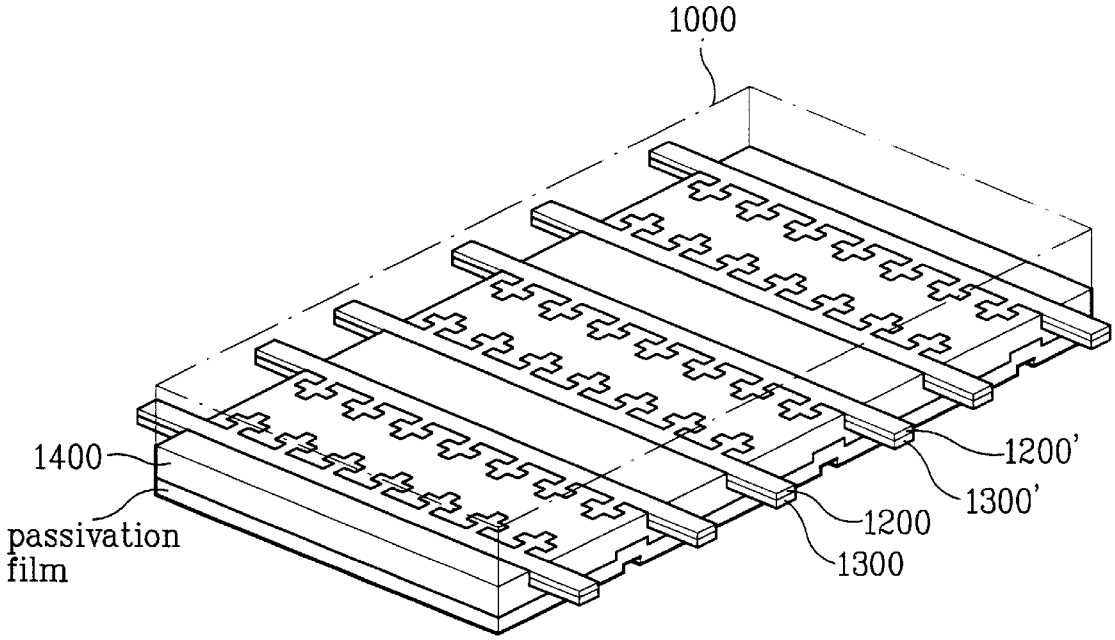
FIG. 5 is a perspective view showing a plasma display panel according to the present invention.
Figure 6:
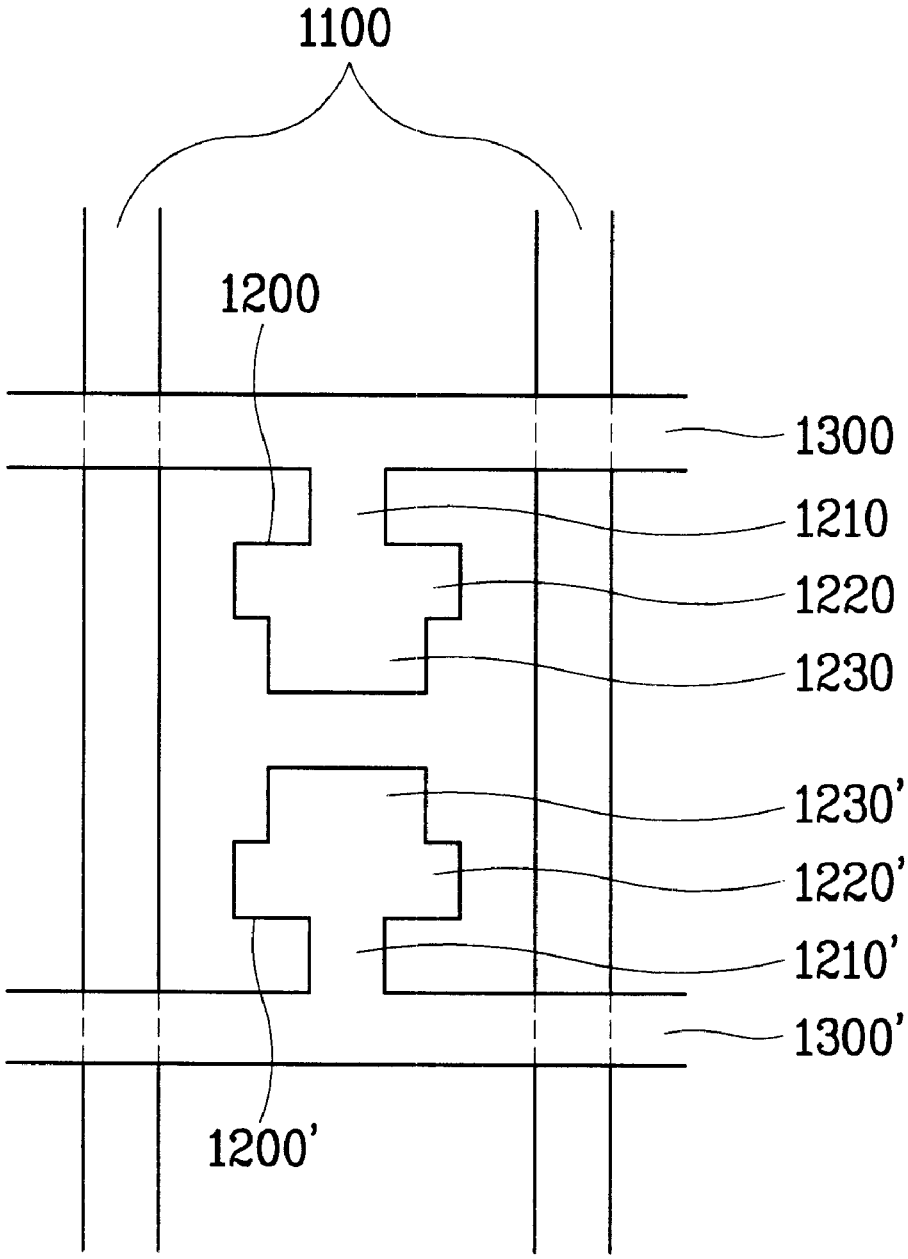
FIG. 6 is a plane view showing a structure of a discharge electrode according to the present invention.
Figure 7:
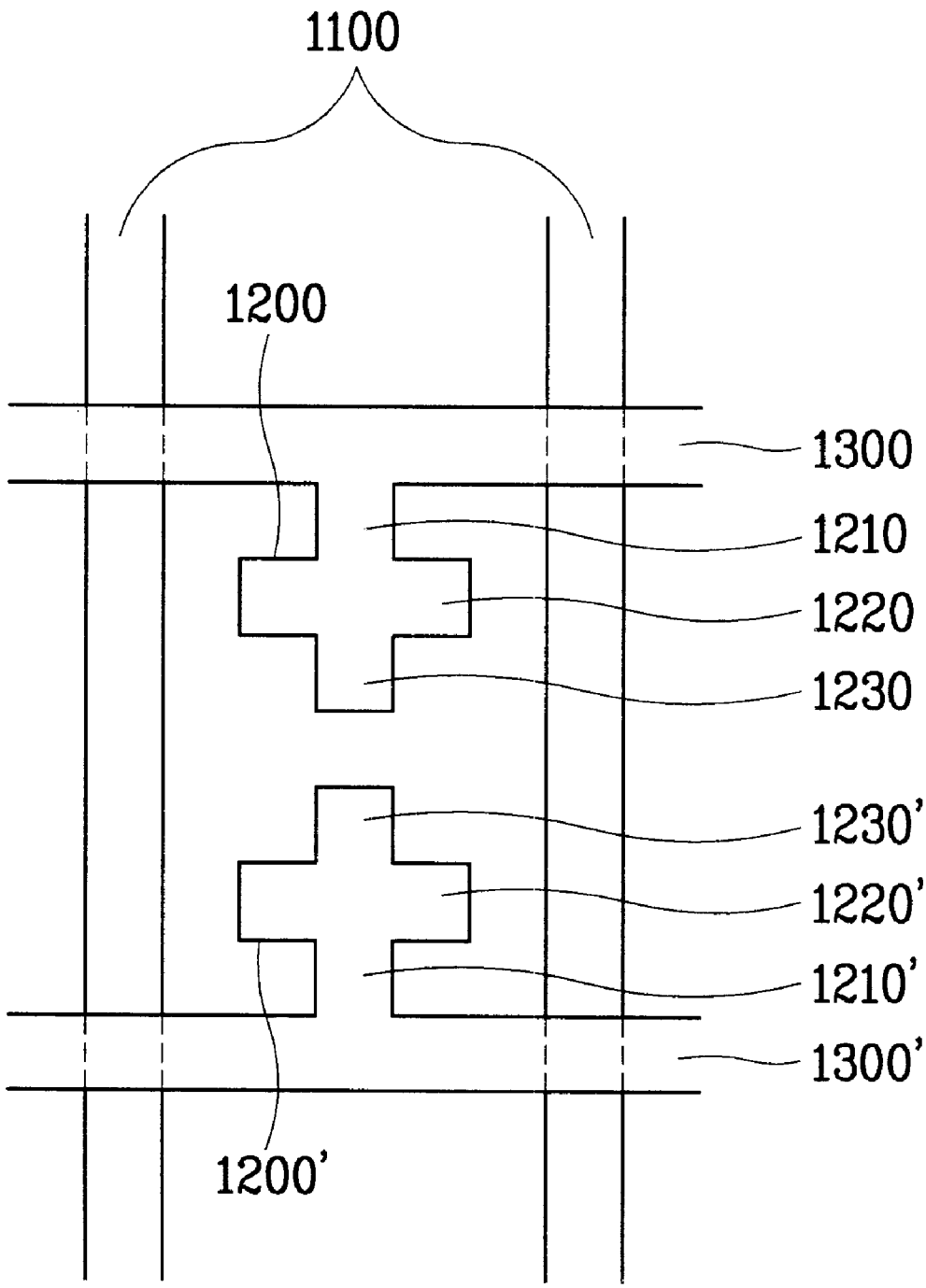
FIG. 7 is a plane view showing another structure of a discharge electrode according to the present invention.

FIGS. 6 and 7 are plane views showing structures of the first and second discharge electrodes.

Each of the first and second discharge electrodes 1200 and 1200' is desirably made of a conductive transparent electrode, particularly, Indium Tin Oxide (ITO). It is desirable that the distances between the respective first discharge electrodes are all the same as one another. It is also desirable that the distances between the respective second discharge electrodes are all the same as one another.

The dielectric layer is deposited on areas between the first and second discharge electrodes 1200 and 1200' at a first thickness and also deposited on some areas on the first and second discharge electrodes 1200 and 1200' at a second thickness thinner than the first thickness. At this time, a width of the areas deposited at the first thickness is in the range of about 100 $\mu$m to 300 $\mu$m and is similar to the distance between the first and second discharge electrodes 1200 and 1200'. The first thickness is in the range of about 10 $\mu$m to 100 $\mu$m, more preferably, 30 $\mu$m to 40 $\mu$m.

A width of the areas deposited at the second thickness is thinner than that of the areas deposited at the first thickness. Desirably, the difference between the first thickness and the second thickness is in the range of 5 $\mu$m to 100 $\mu$m, more preferably, 10 $\mu$m to 20 $\mu$m.

Figure 8:
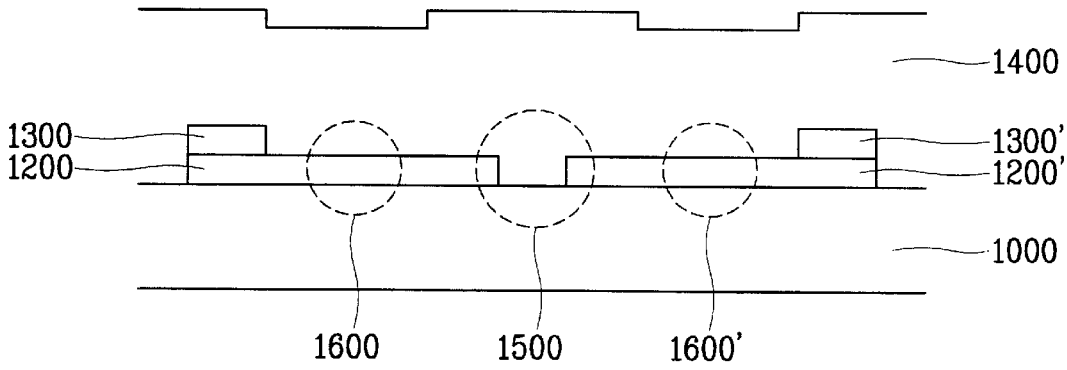
FIG. 8 is a sectional view showing a structure of a dielectric layer according to the present invention.
Figure 9:
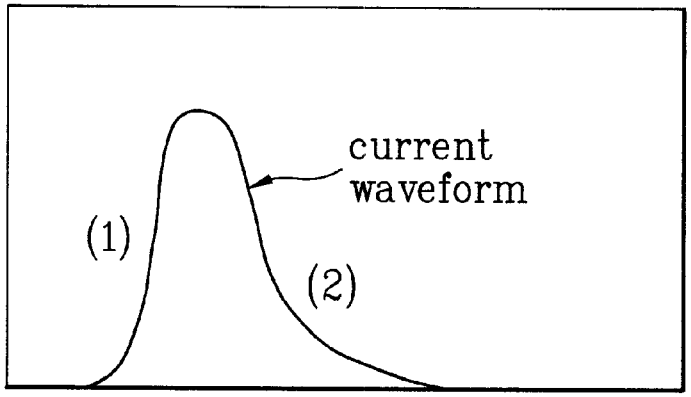
FIG. 9 Background Art
FIG. 9 is a graph showing a waveform of discharge current in a related art plasma display panel.

FIG. 8 is a sectional view showing a structure of the dielectric layer.

The plasma display panel of the present invention generates discharge according to the following principles.

First, if discharge occurs between an end 1230 of the first discharge electrode 1200 and an end 1230' of the second discharge electrode 1200', wall charge occurs along a surface of the dielectric layer (not shown). An area between the ends 1230 and 1230' is a field convergence area. The wall charge lowers the potential in the discharge cell, thereby lowering the discharge current.

However, in the discharge cell formed with the first and second discharge electrodes 1200 and 1200' of the present invention, the discharge current increases by the discharge electrode wider than the field convergence area. This increase of the discharge current prevents the discharge current of the centers 1220 and 1220' in the discharge electrodes from being decreased as compared with the discharge current of the field convergence area of the ends 1230 and 1230' in the discharge electrodes. As a result, discharge of the discharge cell is maintained for a long time to generate ultraviolet rays in a positive column area.

Furthermore, if discharge occurs in an area between a pair of the discharge electrodes 1200, i.e., a field convergence area 1500, wall charge occurs along the surface of a dielectric layer 1400. The wall charge on the surface of the dielectric layer 1400 in the field convergence area lowers the potential in the discharge cell. More wall charges occur in the dielectric layer 1400 of field diffusion areas 1600 and 1600', which is thinner than the dielectric layer 1400 of the field convergence area 1500.

In other words, the discharge current of the plasma display panel depends on the thickness of the dielectric layer 1400 on the discharge electrode 1200. If the dielectric layer 1400 is thin, a voltage of the discharge electrode 1200 is likely to be shielded by the wall charge, thereby increasing the discharge current. On the contrary, if the dielectric layer 1400 is thick, it is difficult to shield the voltage of the discharge electrode 1200 by the wall charge, thereby decreasing the discharge current.

Figure 10:
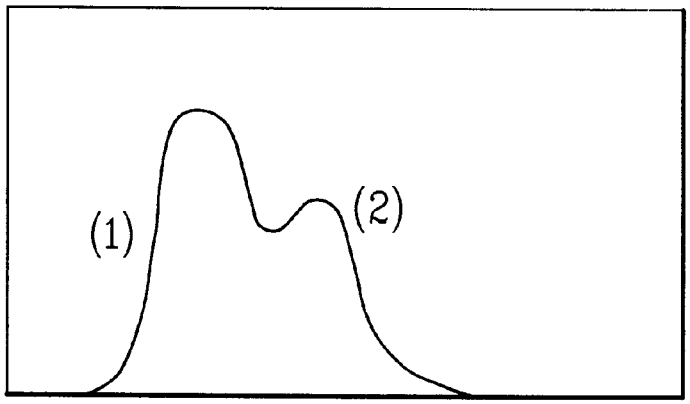
FIG. 10 is a graph showing a waveform of discharge current in the present invention.

After all, in the plasma display panel of the present invention, the discharge current increases by the dielectric layer 1400 thinner than the field convergence area 1500, thereby generating a waveform as shown in FIG. 10. As a result, since the discharge current is maintained over a wider area, the discharge area is diffused to be wider than the related art discharge area, thereby generating ultraviolet rays in the positive column area.

As aforementioned, the discharge current can be controlled by controlling the thickness of the dielectric layer and the thickness of the discharge electrode at the same time or separately.

In other words, the plasma display panel of the present invention may include a plurality of first and second sustain electrodes successively formed on a substrate at a predetermined interval, and a dielectric layer deposited on areas between the respective first and second sustain electrodes at a first thickness and on some areas on the respective first and second sustain electrodes at a second thickness. Alternatively, the plasma display panel of the present invention may include a plurality of first and second bus electrodes successively formed on a substrate at a predetermined interval, a plurality of first discharge electrodes formed with a plurality of first branches branched at a first width for each first bus electrode, a plurality of first centers extended from the respective first branches to a second width greater than the first width, and a plurality of first ends extended from the respective first centers to a third width smaller than the second width, and a plurality of second discharge electrodes successively branched for each second bus electrode at a predetermined interval and spaced apart from the first ends.

The aforementioned plasma display panel of the present invention has the following advantages.

In the plasma display panel of the present invention, the center of the discharge electrode formed in the field diffusion area is wider than the end of the discharge electrode formed in the field convergence area, and the dielectric layer of the field diffusion area is thinner than the dielectric layer of the field convergence area. This increases the discharge current of the field diffusion area so that the discharge area is diffused to generate ultraviolet rays in the positive column area unlike the related art plasma display panel. As a result, emitting efficiency and luminance becomes higher as compared with the related art plasma display panel.

It will be apparent to those skilled in the art that various modifications and variations can be made in the plasma display panel according to the present invention without departing from the spirit or scope of the invention. Thus, it is intended that the present invention covers the modifications and variations of the invention provided they come within the scope of the appended claims and their equivalents.

What is claimed is:

1. A plasma display panel comprising:

a plurality of first and second bus electrodes successively formed on a substrate at a predetermined interval;

a plurality of first discharge electrodes formed with a plurality of first branches branched at a first width for each first bus electrode, a plurality of first centers extended from the first branches to a second width greater than the first width, and a plurality of first ends extended from the first centers to a third width smaller than the second width;

a plurality of second discharge electrodes successively branched at a predetermined interval for each second bus electrode and spaced apart from the first ends; and a dielectric layer deposited on areas between the first and second discharge electrodes at a first thickness and on some areas on the first and second discharge electrodes at a second thickness.

2. The plasma display panel as claimed in claim 1, wherein each of the second discharge electrodes includes a second branch branched at a fourth width for each second bus electrode, a second center extended from the second branch to a fifth width greater than the fourth width, and a second end extended from the second center to a sixth width smaller than the fifth width.

3. The plasma display panel as claimed in claim 2, wherein the fourth width and the sixth width are the same as each other.

4. The plasma display panel as claimed in claim 2, wherein the sixth width is wider than the fourth width.

5. The plasma display panel as claimed in claim 2, wherein distances between the respective second discharge electrodes are the same as one another.

6. The plasma display panel as claimed in claim 1, wherein the first width and the third width are the same as each other.

7. The plasma display panel as claimed in claim 1, wherein the third width is wider than the first width.

8. The plasma display panel as claimed in claim 1, wherein the dielectric layer deposited at the first thickness has a width of 100 $\mu$m to 300 $\mu$m.

9. The plasma display panel as claimed in claim 1, wherein the first thickness is in the range of 10 $\mu$m to 100 $\mu$m.

10. The plasma display panel as claimed in claim 9, wherein the first thickness is in the range of 30 $\mu$m to 40 $\mu$m.

11. The plasma display panel as claimed in claim 1, wherein a difference between the first thickness and the second thickness is in the range of 5 $\mu$m to 100 $\mu$m.

12. The plasma display panel as claimed in claim 11, wherein a difference between the first thickness and the second thickness is in the range of 10 $\mu$m to 20 $\mu$m.

13. The plasma display panel as claimed in claim 1, wherein the first and second bus electrodes are made of metal material.

14. The plasma display panel as claimed in claim 1, wherein the first and second discharge electrodes are made of conductive transparent electrode.

15. The plasma display panel as claimed in claim 1, wherein distances between the respective first discharge electrodes are the same as one another.

16. A plasma display panel comprising:

a plurality of first and second bus electrodes successively formed on a substrate at a predetermined interval;

a plurality of first discharge electrodes formed with a plurality of first branches branched at a first width for each first bus electrode, a plurality of first centers extended from the first branches to a second width greater than the first width, and a plurality of first ends extended from the first centers to a third width smaller than the second width; and a plurality of second discharge electrodes successively branched at a predetermined interval for each second bus electrode and spaced apart from the first ends.

* * * * *